United States Patent [19]

Gingerich

[11] 4,232,592

[45] Nov. 11, 1980

[54] ENVELOPE FORMING MACHINE AND METHOD

[75] Inventor: David L. Gingerich, Farmington, Mich.

[73] Assignee: Champion International Corporation, Stamford, Conn.

[21] Appl. No.: 950,626

[22] Filed: Oct. 12, 1978

[51] Int. Cl.[3] ..... B31B 1/20

[52] U.S. Cl. ..... 493/10; 83/268; 493/250; 493/266

[58] Field of Search ..... 93/61 A, 61 R, 61 AC, 93/62; 83/212, 235, 268, 370, 911; 118/677

[56] References Cited

U.S. PATENT DOCUMENTS

| | | | |
|---|---|---|---|
| 2,651,283 | 9/1953 | Zinn | 118/677 |
| 3,600,998 | 8/1971 | Palmer | 83/268 X |
| 3,745,894 | 7/1973 | Helm | 93/61 R |
| 3,869,965 | 3/1975 | Howatt | 93/61 A |

*Primary Examiner*—Robert D. Baldwin

*Attorney, Agent, or Firm*—Evelyn M. Sommer

[57] ABSTRACT

A machine for forming envelopes from blanks comprising a scoring means for receiving said blanks and adding score lines thereto, means for receiving said blanks from said scoring roller and applying glue to selected first locations thereon, means receiving said blanks with applied glue and folding said blanks to cause a seal at said glue locations, means for receiving said folded blanks and inverting said blanks whereby a first portion of said blanks is stationary while said blanks are being inverted, means located at said blank inversion means for forming a desired shape in said stationary portion of said blanks while said blanks are being inverted and means for receiving said formed blanks for gluing and folding said blanks to form completed envelopes.

3 Claims, 3 Drawing Figures

ENVELOPE FORMING MACHINE AND METHOD

BACKGROUND OF THE INVENTION

There are many different types of envelopes in use today, and a great number of these envelopes are for special uses or purposes. One of these special uses is in the computer field wherein an envelope is required to store magnetic recordings known as floppy disks. These envelopes must protect the magnetic disk and prevent it from being scratched or otherwise damaged. Inasmuch as many of these magnetic disks are stored, a portion of the envelope extends above the body of the envelope which stores the disk in order that identification means can be attached thereto for the purpose of retrieving the disks when needed. The prior art material out of which these envelopes is formed is a polyethelene material under the trademark name of "TYVEK."

These envelopes as formed in the prior art are unacceptable because the portion extending above the body of the envelope storing the disk is a panel that is so flimsy that with repeated handling, it becomes dog eared and droops so that it is difficult to locate a particular disk that is stored in the files. In order to overcome this disadvantage, the extended panels are made with double thickness in order to provide greater rigidity and durability. Further, instead of a single panel extending above the envelope body where the disk is stored, it is desired to have such envelopes with tabs protruding from the extended panel of the envelope for identification purposes with the tabs punched out such that they are located in approximately five different horizontal locations to provide easier access and visibility when searching for a particular disk, this poses a special problem in the prior art because with prior art machines, the envelopes have to be side guided for the punching to take place and the material TYVEK cannot be side guided. Thus, an additional machine or separate machine operation is required in order to form the necessary tabs in the top of the magnetic disk envelope. In either case, the cost is more expensive because of the additional machine or the time required to run the envelopes through an additional tab forming step for the separate machine operation.

Further, the blanks from which these envelopes are formed are required to go through a gluing operation which applies the glue to the proper locations prior to folding and forming the envelope itself. In one apparatus for applying glue to desired locations on the envelope blank, the blank passes between two rollers, one of which is a driving roller and the other of which is the glue application roller. If for any reason an envelope is not present as the glue application roller completes its circular movement, it applies the glue to the drive roller which of course creates problems inasmuch as the following envelope will receive glue not only on the top from the glue application roller but also on the bottom thereof from the drive roller. The unit must then be stopped and the drive roller cleaned before the machine can continue to be operated. The prior art method of avoiding this problem has been to use a finger switch which closes when no envelope is present to be glued, thus completing part of a circuit to a device for moving the drive roller out of contact with said glue application roller. Further, inasmuch as the drive roller needs to be moved out of contact with the glue application roller only when the glue application roller is in such a position as to apply glue to the driving roller, the position of the glue application roller must also be determined. In the prior art, a commutator element is attached to the glue application roller and makes electrical contact with a contact finger only when the roller is in the proper position to apply glue to an envelope passing between the glue application roller and the drive roller. Both the finger switch for detecting the presence of the envelope and the commutator switch for determining the proper position of the glue application roller are disadvantageous in that they wear with time and require adjustment with age in order to function properly. Again, of course, the adjustment or parts replacement cost is expensive and adds to the consumer cost of the envelopes.

SUMMARY OF THE INVENTION

The present invention relates generally to a machine and method for making envelopes of any type but specifically of the type for storing floppy disks wherein the problem of getting glue on the driving roller associated with the glue application roller when no envelope is present is avoided, and no extra time is required in the process to properly shape the envelopes to provide tabs at the top thereof for easy identification purposes.

Specifically, the invention relates to apparatus for shaping an envelope blank comprising an envelope inverting mechanism for receiving an envelope blank and holding a first part thereof stationary while said blank is being inverted, and means located at said inverting mechanism for forming a desired shape in the stationary portion of said envelope blank while said blank is being inverted.

Further, the invention relates to a machine for serially forming envelope blanks comprising a means for receiving said blanks and adding score lines thereto, means for receiving said blanks from said scoring means and applying glue to selected first locations on said blanks, means receiving said blanks with applied glue and folding said blanks to cause a seal at said glue locations, means for receiving said folded blanks and inverting said blanks whereby a first portion of said blanks is stationary while said blanks are being inverted, means located at said inverting means for forming a desired shape in said stationary portion of each of said blanks while said blanks are being inverted and means for receiving said formed blanks and folding said blanks to form completed envelopes.

In addition, the invention relates to apparatus for applying glue to selected locations on an envelope blank comprising a glue application roller and a drive roller operatively with said glue application roller for receiving therebetween an envelope blank to receive glue in selected areas thereof, a first photo cell for detecting the presence of said blank and producing a first output signal when said blank is present, a second photo cell for monitoring the angular position of said glue application roller and producing a second output signal when said glue application roller is in the proper position to apply glue to the next envelope blank as it passes said glue application roller, and means coupled to said first and second photo cells for moving said drive roller away from said glue application roller when only said second output signal is present.

Further, the invention also relates to apparatus for applying glue to selected locations on an envelope blank comprising a photo cell for detecting the presence of an envelope blank to receive glue and producing an output signal when said blank is present, means for spraying said glue in a predetermined pattern on said blank under pressure, and a signal delay network coupling said photo cell output to said glue spraying means whereby glue is sprayed in said predetermined pattern on said blank only when said blank is in the proper location to receive said sprayed glue.

Also, the invention is related to a method of shaping an envelope blank comprising the steps of directing an envelope blank into an inverting mechanism whereby one portion of said envelope blank is momentarily stationary in said mechanism while said envelope blank is being inverted and forming a desired shape in the stationary portion of said envelope blank during the period of time said envelope is being inverted whereby no additional time is required to shape said blank.

BRIEF DESCRIPTION OF THE DRAWINGS

These and other objects and advantages of the present invention will be disclosed in the course of the following specification, reference being had to the accompanying drawings in which.

DESCRIPTION OF THE PREFERRED EMBODIMENT

The present invention is directed to an envelope forming machine and method in which any type of envelope may be formed but is specifically directed to a machine and method for forming floppy disk envelopes and will be described accordingly.

Figures 1, 2:
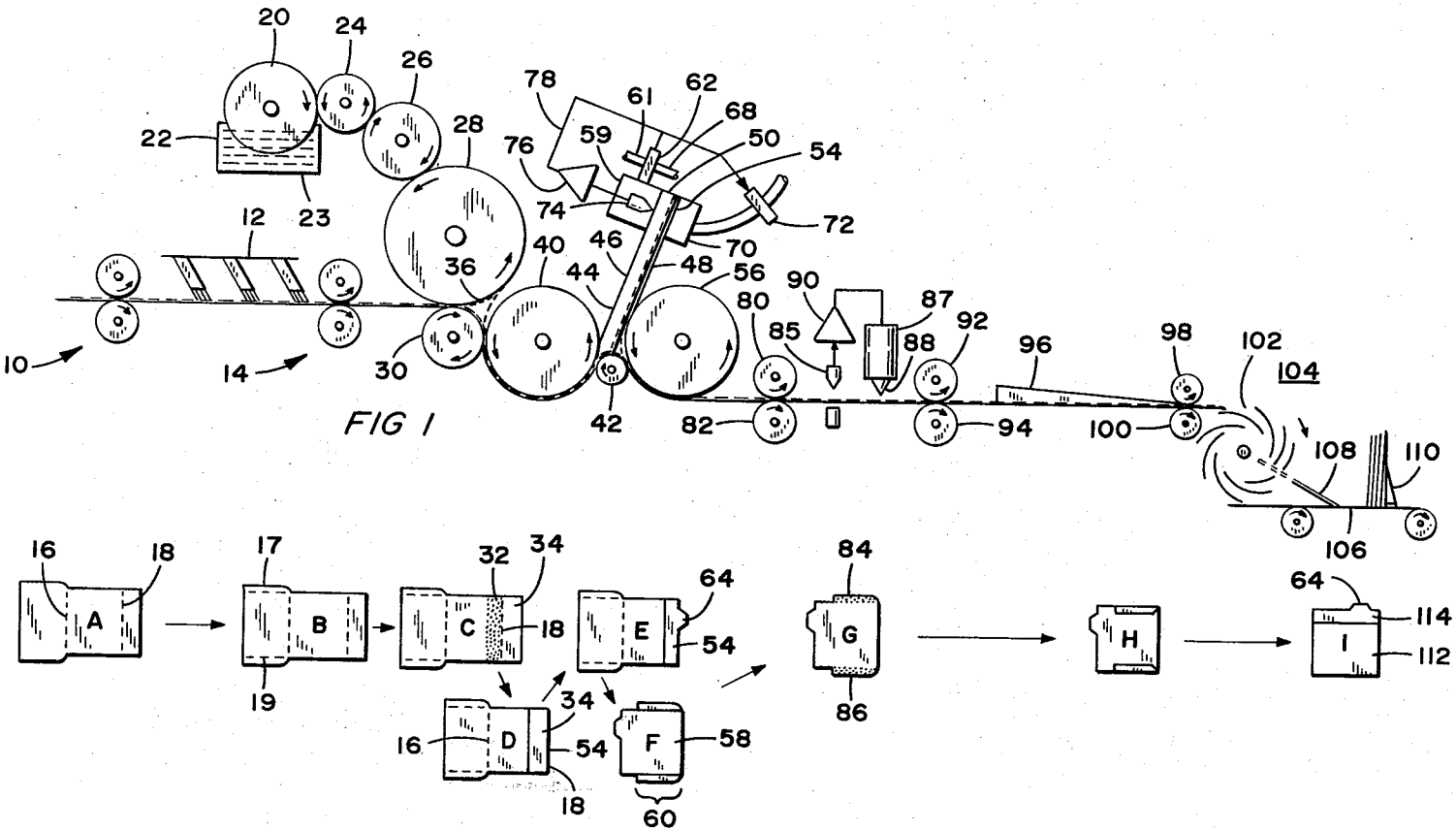
FIG. 1 illustrates a longitudinal, diagrammatic view of the machine for carrying out the novel method in accordance with the present invention.
FIG. 2 is a diagrammatic view showing the successive envelope blanks after each step involved in scoring, gluing, punching, and folding the envelopes in successive stages to form the finished product.

FIG. 1 is a longitudinal side view of the envelope making machine of the present invention. The envelopes are fed into the machine through rollers 10 to an aligning station wherein brushes 12 align and hold down the envelope blanks so that they can properly be received by scoring rollers 14. Envelope blank A shown in FIG. 2 illustrates the condition of the blank as it enters the envelope forming machine of FIG. 1. Scorelines 16 and 18 have already been imprinted on blank A by well known means. Scoring means such as rollers 14 of FIG. 1 add score lines 17 and 19 as shown on blank B in FIG. 2. After blank B passes through scoring means 14 and score lines 17 and 19 added thereto, the blank enters the first gluing operation. In this operation, a glue source roller 20 is partially immersed in a glue tray 22, and as it turns the glue 23 adheres to the surface thereof. Glue transfer roller 24 is in contact with glue source roller 20 and the glue is transfered then from roller 20 to roller 24. Roller 26 is a pattern roller which has thereon the pattern of the glue which is to be applied to the envelope. As the pattern comes in contact with roller 24, the glue is transfered to the pattern and from pattern roller 26 is transfered to glue application roller 28. The envelope blank is being driven by roller 30 and it is pulled between glue application roller 28 and drive roller 30 and the glue on roller 28 is transfered to the envelope blank. Blank C as shown in FIG. 2 illustrates the glue having been applied to area 32 thereon. As the front portion of the envelope blank C passes between rollers 28 and 30, a vacuum in roller 28 grasps forward portion 34 of the blank in a well known manner and tends to pull it up along path 36 under drum 28. However, a vacuum in drum 30 tends to pull the portion of the envelope blank having glue thereon in the area under score line 18 in a downward direction along path 38. The vacuum on drum 28 is then released and the blank is caused to fold along score line 18 as shown in blank D in FIG. 2 as it is pulled between drums 30 and 40. Thus, portion 34 is folded over and glued to the area 32 where the glue is deposited in the previous step.

The blank as shown by blank D in FIG. 2 is then fed under roller 40 and between roller 40 and roller 42. These rollers guide the blank into a chute 44 which serves as a blank inverter. The envelope inverter is old and well known in the art and chute 44 is formed as a channel between plates 46 and 48. The distance from the upper terminal wall 50 of chute 44 to roller 42 must be slightly less than the dimension from the top 54 of envelope blank D shown in FIG. 2 to score line 16 near the center thereof. Thus, the top 54 of envelope blank D as shown in FIG. 2 is fed by rollers 40 and 42 into chute 44 and ultimately comes in to contact with terminal wall 50. When this happens, the envelope blank cannot be forced further into chute 44. As rolls 40, 42 and 56 continue to turn, a vacuum in roller 42 causes the envelope blank to bend at score line 16 in the direction of the point of contact between roll 42 and roll 56. When the envelope blank has deformed far enough, it will be caught between rollers 42 and 56 and the rotation of these rollers will serve to fold the blank about score line 16 with the top 58 thereof folded over the base 60 as shown in FIG. 2 by envelope blank F.

It will be noted that inasmuch as the top 54 of the envelope blank D as shown in FIG. 2 comes in contact with terminal wall 50 of chute 44 and can go no further while the base 60 of the envelope blank continues to move in between rollers 42 and 56, the top 54 is stationary momentarily within chute 44. This then would be an appropriate time to shape the top 54 to produce a desired tab thereon. Thus, a shaping or forming device such as a punch press 59 of the air driven type is mounted at the outer end of chute 44 to perform the necessary shaping operation. High pressure air is coupled through input 61 to a solenoid operated valve 62 and to air driven punch press 59. When the solenoid valve 62 is activated, the high pressure air enters valve 62 through input 61 and causes punch press 59 to cut or shape the top of the envelope blank as shown in FIG. 2 by blank E. It will be seen therein that a tab 64 is formed. Based upon the shape of the die cutter being used with the punch press, tab 64 can be placed in any one of five positions across the top 54 of blank E.

When solenoid valve 62 is deactivated, the high pressure air exhausts from punch press 59 through exhaust tube 68. Further, a vacuum 70 is placed in proximity to punch press 59 to remove the material chips that are cut from the blank. A second solenoid valve 72 may provide intermittent vacuum to the operation as needed or the vacuum may be continuous if desired. The material chips are thus removed and are not allowed to stay within the machine where they may cause operational problems. Thus, it can be seen that the novel location of punch press 59 not only performs the needed function of shaping the top of the envelope blank, but does it without the requirement of any additional time during the process of making the envelope. If the shaping operation took place at any other step in the process, the additional time required to punch or otherwise form each envelope and shape the top thereof would amount to a large number of hours for each envelope job. With the present invention, however, no extra time is required at all, thus, providing a large savings to the manufacturer.

In order to determine the appropriate time to activate solenoid valve 62 so that shaping means 59 can properly shape the top of envelope blank, a photo cell 74 is so positioned on chute 44 that it detects the point at which the envelope blank has reached terminal wall 50 of chute 44 and can move no further. At that point, photo cell 74 produces a signal which is coupled to amplifier 76 which produces an output on line 78 that is coupled to solenoid valve 62 to cause it to assume a position allowing high pressure air through input tube 61 to be admitted to punch press 59. Thus, punch press 59 operates at the exact point during which the envelope blank is stationary to shape the upper edge thereof and provide tab 64. When the solenoid valve 62 is deactivated and the signal removed therefrom, the high pressure air is exhausted through exhaust line 68. The electrical signal on line 78 may also be used to activate second solenoid valve 72 to operate the vacuum system to remove the material chips. It is obvious that photo cell 74 can be placed in any desired and convenient location along chute 44. It will be understood that a time delay 76 can always be placed in the circuit to cause the signal to activate solenoid valve 62 just as the envelope blank reaches the terminal wall 50 and can travel no further. Thus, the photo cell as indicated in FIG. 1 is positioned for illustrative purposes only and need not be positioned exactly as shown. The result that must be obtained wherever it is positioned is to cause activation of solenoid valve 62 at the moment the envelope blank reaches terminal wall 50 and can move no further.

After the envelope blank has been shaped and is pulled between rollers 42 and 56 and thus folded to form blank F as shown in FIG. 2, blank F is passed between feed rollers 80 and 82 to the second gluing station. At this station, it is desired to place glue on side flaps 84 and 86 so that in the succeeding stations the side flaps 84 and 86 can be folded over the main body of the envelope blank and the envelope thus completed. Therefore, photo cell 85 detects the presence of envelope blank G as shown in FIG. 2 and sends a signal to glue spraying unit 87 which has nozzles 88 so spaced as to properly apply glue to sidewall flaps 84 and 86. Glue source 87 is pressurized and has a valve means, also well known in the art, which is activated by the signal from photo cell 85 to cause the glue to be sprayed on the envelope blank sidewalls 84 and 86 at the proper time. Again, photo cell 85 can be placed in any convenient location and, if necessary, a delay unit 90 may be placed in the circuit between photo cell 85 and pressurized glue source 87 to enable the signal from photo cell 85 to activate the glue source valve at the proper time so that the glue will be sprayed on sidewall panels 84 and 86 in the proper locations. After the sidewall panels 84 and 86 have been sprayed with glue, the envelope blank G as shown in FIG. 2 passes between rollers 92 and 94 which feed the blank into the side folder 96. Side folder 96 is old and well known in the art and simply folds side flaps 84 and 86 over the main body of the envelope blank as shown by blank H in FIG. 2. As blank H is fed between rollers 98 and 100, the seal is affected between sidewall flaps 84 and 86 and the main body of the envelope as shown by blank H in FIG. 2.

The completed envelopes are passed into the arcuate slots 102 of several spiral wheels 104. The spiral wheels 104 carry the envelope blanks downwardly while they rest in the slots 102. Finger 108 intersects the path of travel and lifts the envelopes out of the slots 102 and down finger 108 to belt 106 which moves in a direction away from the machine. The envelopes are delivered in a vertical position and are so maintained by means of a support 110 which sits on top and moves with belt 106. Accumulated envelopes are removed from the belt by an attendant and packed. The completed envelopes are as shown by envelope I in FIG. 2. Thus, the envelope has a pocket 112 in which the magnetic disk can be placed and an extended flap or panel 114 in which a tab 64 is formed for purposes of identification during filing. As stated earlier, tab 64 can be placed in any one of five positions across the top of the envelope extended flap 114, but only two are shown in FIG. 2 for ease of illustration; the one on blank H and the other on blank I.

Thus, the novel envelope making machine not only glues and folds the blank to form the proper envelope, but also shapes the top of the envelope to provide a tab thereon without any extra time being involved in the envelope making process.

Figure 3:
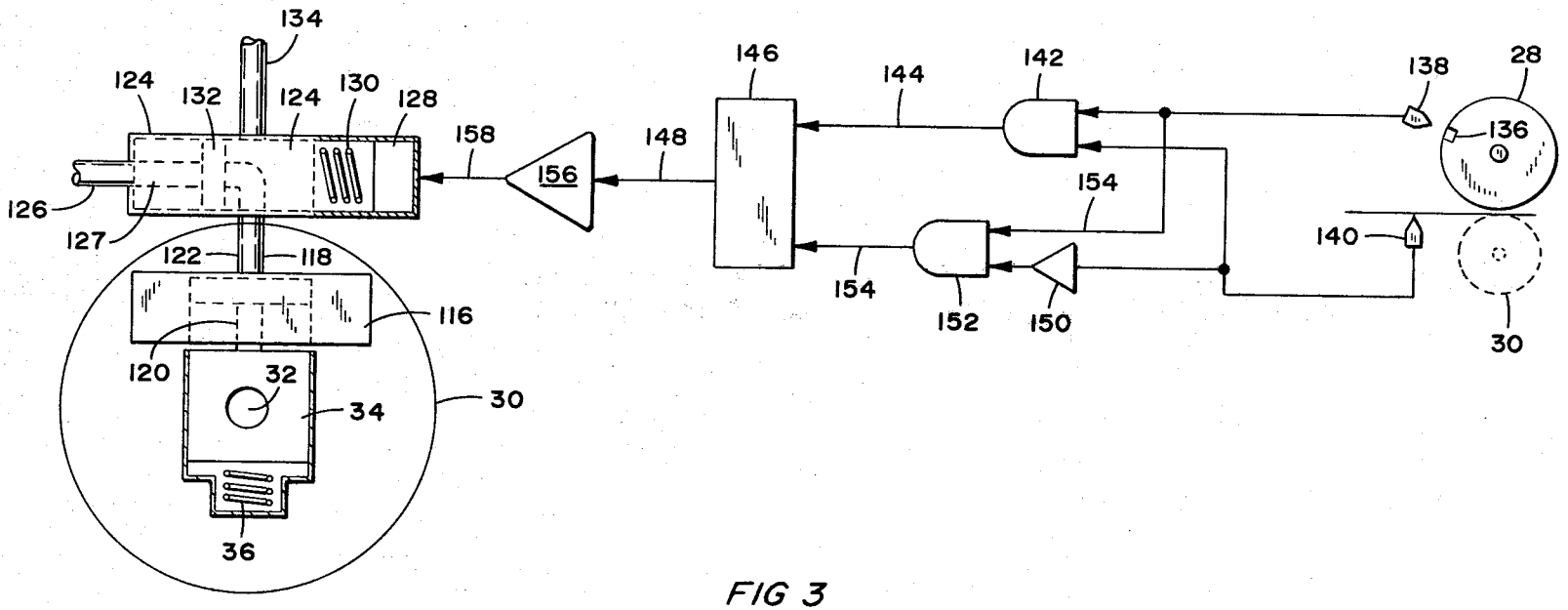
FIG. 3 is a diagrammatic illustration of the circuitry and apparatus for moving the drive roller out of contact with the glue application roller whenever an envelope is not present to receive glue.

FIG. 3 is a diagramatic illustration of the apparatus and electrical circuit involved in moving drive roller 30 shown in FIG. 1 away from glue application roller 28 whenever an envelope blank is not present for gluing but application wheel 28 is in the proper position to apply glue thereto. As will be shown in FIG. 3, drive roller 30 has its drive shaft 32 mounted in a bearing block 34 which rests on spring 36. Spring 36 presses up against bearing block 34 and thus holds drive roller 30 in operative contact with glue application roller 28. As stated earlier, without a corrective mechanism, if no envelope is present when glue application roller 28 comes in contact with drive roller 30, the glue is transfered to roller 30 which then deposits the glue on the bottom of the next blank that passes through the machine. Obviously, this causes unwanted problems and delays in the process of making envelopes. Thus, a system is designed such that if glue application roller 28 is in the proper position to deposit the glue on an envelope, and no envelope is present, drive roller 30 is moved downwardly away from glue application roller 28 to prevent glue from being applied to roller 30.

To accomplish this purpose, cylinder 116 has therein piston 118 having a shaft 120 which is coupled to bearing block 34. When high pressure air is coupled through input tube 122 to the top of piston 118 in cylinder 116, the piston 118 is moved downwardly thus pushing bearing block 34 against spring 36 and compressing spring 36. Since roller 30 has its shaft 32 in bearing block 34, the entire roller 30 is moved down just enough distance to allow roller 28 to pass without depositing glue on roller 30. Normally, input tube 122 is coupled through valve 124 to an exhaust port 126. However, if solenoid 128 is electrically actuated, it causes the valve body 124 to move to the right against spring 130 and aligns port 132 with input port 134 thus passing high pressure air through input port 134, orifice 132, and conduit 122 to the face of piston 118 thus moving bearing block 34 downwardly. When solenoid 128 is deenergized, spring 130 returns valve body 124 to the left, thus disconnecting orifice 132 from input port 134 and connecting exhaust port 126 to tube 122 through orifice 127 which exhausts the air from the top of cylinder 118 and allows spring 36 to force bearing block 34 upwardly and restores drive roller 30 to its position immediately adjacent and contiguous to glue roller 28 thus preparatory for receiving the next blank to receive glue.

The electrical circuit for operating solenoid 128 is shown in FIG. 3. Glue application roller 28 has thereon indicia 136 which may be of any acceptable type such as reflecting tape or a depression in glue application roller 28. A first photo cell 138 is so positioned that it detects indicia 136 whenever glue application roller 28 is in the proper position to deposit glue on an envelope which would normally be passing between glue application roller 28 and drive roller 30. A second photo cell 140 is so positioned as to detect the presence of said envelope blank which is to receive glue as it passes between glue application roller 28 and drive roller 30. If both photo cells 138 and 140 produce an output, thus representing that glue application roller 28 is in the proper position to deliver glue and an envelope blank is present to receive the glue, their signals are coupled to AND gate 142 which produces an output on line 144 and sets flip flop 146. In its set state, flip flop 146 produces no output on line 148. Thus, no signal is applied to solenoid 128 and roller 30 is held in operative contact with glue application roller 28 by spring 36 pressing upwardly against bearing block 34 which carries roller 30. Assume however, that glue application roller 28 is in the proper position to deliver the glue to an envelope blank but no envelope blank is present. In this condition, it is desired to move drive roller 30 away from operative contact with glue application roller 28. Since photo cell 140 produces no signal because of the absence of the envelope blank, the output of inverter 150 is a signal which is coupled to AND gate 152 along with the signal on line 154 from photo cell 138. It will be remembered that photo cell 138 produces a signal when glue application roller 28 is in the correct position to deposit the glue on an envelope. With both signals present as inputs to AND gate 152, an output on line 154 is coupled to flip flop 146 to reset the flip flop. When it resets, flip flop 146 produces an output signal on line 148 which is amplified by amplifier 156 and coupled via line 158 to solenoid 128. In that condition, solenoid 128 is energized, the valve body 124 is moved to the right, and the high pressure input air is coupled through input port 134, orifice 132, tube 122 and the face of piston 118 to move drum 30 downwardly as previously explained.

Thus, the roller 30 will be held downwardly until such time as the glue application roller is again in position to deliver glue to an envelope blank as determined by photo cell 138 and an envelope blank is detected by photo cell 140 thus activating AND gate 142 and setting flip flop 146 to remove the output on line 148 thereby allowing solenoid 128 to be deenergized and valve body 124 be returned to its normal position by spring 130 thereby exhausting the high pressure air from the top of piston 118 in cylinder 116.

It will be seen therefore, that a novel envelope making machine and method has been described which not only speeds up the process of producing the envelopes but also avoids maintenance problems and time consuming operations to shape the envelope blank.

While the invention has been described in connection with a preferred embodiment, it is not intended to limit the scope of the invention to the particular form set forth, but, on the contrary it is intended to cover such alternatives, modifications, and equivalents as may be included within the spirit and scope of the invention as defined by the appended claims.

What is claimed is:

1. A machine for serially handling, gluing and shaping envelope blanks comprising:

a. a scoring roller for receiving said blanks and adding score lines thereto, b. means for receiving said blanks from said scoring roller and applying glue to selected first locations on said blanks, said last named means including (i) a drive roller and a glue application roller in operative association therewith to apply glue to selected areas of an envelope blank passing between said rollers, (ii) a first photo cell for detecting the presence of said blank and producing a first output signal when said blank is present, (iii) means coupled to said first and second photo cells for moving said drive roller out of contact with said application roller when only said second output signal is present, c. means receiving said blanks with applied glue and folding said blanks to cause a seal at said glue locations, d. means for receiving said folded blanks and inverting said blanks whereby a first portion of said blanks is stationary while said blanks are being inverted, e. means located at said inverting means for forming a desired shape in said stationary portion of each of said blanks while said blanks are being inverted, and f. means for receiving said shaped blanks and folding said blanks to form completed envelopes.

2. A machine for serially handling, gluing and shaping envelope blanks comprising:

a. a scoring roller for receiving said blanks and adding score lines thereto, b. means for receiving said blanks from said scoring roller and applying glue to selected first locations on said blanks, c. means receiving said blanks with applied glue and folding said blanks to cause a seal at said glue locations, d. means for receiving said folded blanks and inverting said blanks whereby a first portion of said blanks is stationary while said blanks are being inverted, e. means located at said inverting means for forming a desired shape in said stationary portion of each of said blanks while said blanks are being inverted, said shape forming means including (i) an air driven punch for shaping said envelopes, (ii) a valve coupled to said punch for allowing high pressure air to enter in and exhaust from said punch, (iii) a photo cell for detecting the presence of said envelope blank in the proper location to be shaped and producing a signal when said envelope is present, and (iv) means coupled to said valve and said photo cell for enabling said high pressure air to cause said punch to shape and envelope when said photo cell signal is present, and f. means for receiving said shaped blanks and folding said blanks to form completed envelopes.

3. A method of shaping and folding an envelope blank, comprising:

a. scoring said blank in desired locations, b. applying glue to selected first locations on said blank by (i) passing said blank between a glue application roller and a drive roller, (ii) providing a first photo cell to detect the presence of an envelope blank ready for receiving glue, (iii) monitoring the angular position of said glue application roller with a second photo cell which produces an output when said angular position is correct for depositing glue on the next passing envelope blank, and (iv) moving said drive roller out of contact with said glue application roller when said monitor signals that said glue application roller is prepared to apply glue to said selected first locations and said detector provides a signal representing that no envelope blank is present, c. folding said blank to cause a gum seal at said glue locations, d. inverting said blank whereby one portion of said blank is momentarily stationary while said blank is being inverted, e. forming a desired shape in said stationary portion of said blank while said blank is being inverted, f. applying glue to selected second locations on said envelope blank, and g. folding said blank to form a completed envelope.

* * * * *